US012715556B2

(12) United States Patent
Peoples et al.

(10) Patent No.: US 12,715,556 B2
(45) Date of Patent: Aug. 25, 2026

(54) LIVEWELL SYSTEM

(71) Applicant: Brunswick Corporation, Mettawa, IL (US)

(72) Inventors: Andrew Peoples, Belfast (IE); James S. Wylie, Dromore (GB)

(73) Assignee: Brunswick Corporation, Mettawa, IL (US)

( * ) Notice: Subject to any disclaimer, the term of this patent is extended or adjusted under 35 U.S.C. 154(b) by 645 days.

(21) Appl. No.: 18/299,262

(22) Filed: Apr. 12, 2023

(65) Prior Publication Data

US 2024/0343356 A1 Oct. 17, 2024

(51) Int. Cl.
*B63B 35/26* (2006.01)

(52) U.S. Cl.
CPC ..... *B63B 35/26* (2013.01)

(58) Field of Classification Search
CPC ..... A01K 97/05; A01K 97/20; B63B 35/26; B63B 35/24
USPC ..... 119/226
See application file for complete search history.

(56) References Cited

U.S. PATENT DOCUMENTS 2,822,329 A * 2/1958 Griffith ..... C02F 3/02 210/194
4,748,765 A * 6/1988 Martin ..... A01K 97/05 43/55
4,945,672 A * 8/1990 Raia ..... A01K 97/05 43/57
5,010,836 A * 4/1991 Riviezzo ..... F16K 27/065 251/304
5,397,466 A * 3/1995 Lin ..... A01K 63/045 210/167.01
11,771,066 B2 * 10/2023 Dethlefsen ..... A01K 61/10 119/226
11,970,248 B2 * 4/2024 Garringer ..... B63B 35/26
2021/0284293 A1 * 9/2021 Garringer ..... B63B 79/40
2024/0343356 A1 * 10/2024 Peoples ..... A01K 97/05

FOREIGN PATENT DOCUMENTS

CN 103814861 A 5/2014
CN 106135115 A 11/2016
CN 215992423 U 3/2022

OTHER PUBLICATIONS

Flow-Rite Controls, "Pump-Out Aerator," Byron Center, MI, pp. 29-30.

(Continued)

*Primary Examiner* — Maria E Graber
(74) *Attorney, Agent, or Firm* — Andrus Intellectual Property Law, LLP

(57) ABSTRACT

An assembly for a livewell comprises a first fitting and a second fitting. The first fitting is configured to support and provide water to a spray head configured to spray water into a livewell to which the assembly is coupled. The second fitting is coupled to the first fitting and comprises at least two inlets and at least one outlet, the at least one outlet being in fluid communication with the first fitting. A first inlet of the at least two inlets is in fluid communication with a first source of water to provide water from the first source to the spray head. A second inlet of the at least two inlets is in fluid communication with a different second source of water to provide water from the second source to the spray head.

19 Claims, 8 Drawing Sheets

(56) References Cited

OTHER PUBLICATIONS

Peoples et al., "Livewell System," U.S. Appl. No. 17/666,756, filed Feb. 8, 2022.
Kollmann et al., "Livewell System and Method," U.S. Appl. No. 17/666,761, filed Feb. 8, 2022.
Kollmann et al., "Smart Livewell System," U.S. Appl. No. 17/666,884, filed Feb. 8, 2022.
Kollman et al., "Oxygenation of Water in a Livewell System," U.S. Appl. No. 17/667,120, filed Feb. 8, 2022.
European Search Report in corresponding EP Application No. 24168097.4, dated Sep. 9, 2024, 10 pages.
Search Report in corresponding UK Application No. GB2404685.6, dated Jan. 28, 2025, 3 pages.

* cited by examiner

LIVEWELL SYSTEM

FIELD

The present disclosure relates to systems for maintaining aquatic life in a tank.

BACKGROUND

U.S. patent application Ser. No. 17/666,761, which is hereby incorporated by reference herein in its entirety, discloses a livewell system for a marine vessel including a tank configured to hold water, a fill pump configured to pump water into the tank from a body of water in which the marine vessel is located, and a recirculation pump configured to pump water out of the tank and subsequently back into the tank. A first temperature sensor senses a temperature of the water in the body of water, and a second temperature sensor senses a temperature of the water in the tank. A controller is provided in signal communication with the fill pump, the recirculation pump, and the first and second temperature sensors. The controller operates the fill pump and the recirculation pump based on information from the first and second temperature sensors to maintain the temperature of the water in the tank within a predetermined temperature range. A method for maintaining livewell water temperature is also provided.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one example of the present disclosure, an assembly for a livewell comprises a first fitting and a second fitting. The first fitting is configured to support and provide water to a spray head configured to spray water into a livewell to which the assembly is coupled. The second fitting is coupled to the first fitting and comprises at least two inlets and at least one outlet, the at least one outlet being in fluid communication with the first fitting. A first inlet of the at least two inlets is in fluid communication with a first source of water to provide water from the first source to the spray head and a second inlet of the at least two inlets is in fluid communication with a different second source of water to provide water from the second source to the spray head.

In non-limiting examples disclosed herein, the assembly further comprises a water-level sensor supported by the first fitting.

In non-limiting examples disclosed herein, the first fitting comprises a housing for holding the water-level sensor.

In non-limiting examples disclosed herein, the housing comprises a chimney feature which is configured to hold exposed probe ends of the water-level sensor.

In non-limiting examples disclosed herein, the first fitting comprises a threaded outer surface for receiving a threaded nut configured to clamp the first fitting to a wall of the livewell. The first fitting further comprises a channel recessed within the threaded outer surface and configured to hold wires of the water-level sensor.

In non-limiting examples disclosed herein, the assembly further comprises a pump configured to pump water from the first source to the spray head, wherein the pump is configured to pump water to the spray head in response to the water-level sensor not sensing water. The pump is further configured to stop pumping water to the spray head in response to the water-level sensor sensing water.

In non-limiting examples disclosed herein, the assembly further comprises a first pump and a second pump. The first pump is configured to pump water from the first source to the spray head, wherein the first pump is configured to pump water to the spray head in response to the water-level sensor not sensing water and the first pump is further configured to stop pumping water to the spray head in response to the water-level sensor sensing water. The second pump is configured to pump water from the second source to the spray head, wherein the second pump is configured to pump water to the spray head in response to the water-level sensor not sensing water, and wherein the second pump is further configured to stop pumping water to the spray head in response to the water-level sensor sensing water.

In non-limiting examples disclosed herein, the second fitting is a 4-way fitting, the first inlet is located on a first arm of the second fitting, the second inlet is located on a second arm of the second fitting, the at least one outlet is located on a third arm of the second fitting, and a sensor probe is installed in a fourth arm of the second fitting.

In non-limiting examples disclosed herein, the sensor probe is a dissolved oxygen probe.

In non-limiting examples disclosed herein, the assembly further comprises a non-return valve situated downstream of the first inlet, wherein the non-return valve is configured to prevent water that enters the second fitting by way of the second inlet from backflowing through the first inlet.

In non-limiting examples disclosed herein, the at least one outlet is a single outlet and the first fitting is a single fitting comprising a body configured to extend through a hole in a wall of the livewell.

According to another example of the present disclosure, an assembly for a livewell comprises a first fitting, a water-level sensor supported by the first fitting, and a second fitting. The first fitting has an outlet configured to provide water into a livewell to which the assembly is coupled. The second fitting has at least two inlets and at least one outlet, the at least one outlet of the second fitting being in fluid communication with an inlet of the first fitting.

In non-limiting examples disclosed herein, the first fitting comprises a housing for holding the water-level sensor.

In non-limiting examples disclosed herein, the housing comprises a chimney feature configured to hold exposed probe ends of the water-level sensor.

In non-limiting examples disclosed herein, the first fitting comprises a threaded outer surface for receiving a threaded nut configured to clamp the first fitting to a wall of the livewell and a channel recessed within the threaded outer surface and configured to hold wires of the water-level sensor.

In non-limiting examples disclosed herein, the assembly further comprises a non-return valve situated downstream of a first inlet of the at least two inlets of the second fitting, wherein the non-return valve is configured to prevent water that enters the second fitting by way of a second inlet of the at least two inlets from backflowing through the first inlet.

In non-limiting examples disclosed herein, the second fitting is a 4-way fitting, wherein the at least two inlets comprise a first inlet located on a first arm of the second fitting and a second inlet located on a second arm of the second fitting and wherein the at least one outlet is located on a third arm of the second fitting and a sensor probe is installed in a fourth arm of the second fitting.

In non-limiting examples disclosed herein, a first inlet of the at least two inlets of the second fitting is in fluid communication with a first source of water to provide water from the first source to the livewell, and a second inlet of the at least two inlets of the second fitting is in fluid communication with a different second source of water to provide water from the second source to the livewell.

In non-limiting examples disclosed herein, the at least one outlet of the second fitting is a single outlet and the first fitting is a single fitting comprising a body configured to extend through a hole in a wall of the livewell.

In non-limiting examples disclosed herein, the first fitting is configured to support a spray head adjacent the outlet of the first fitting.

BRIEF DESCRIPTION OF THE DRAWINGS

Examples of livewell systems are described with reference to the following Figures. The same numbers are used throughout the Figures to reference like features and like components.

DETAILED DESCRIPTION

Figure 1:
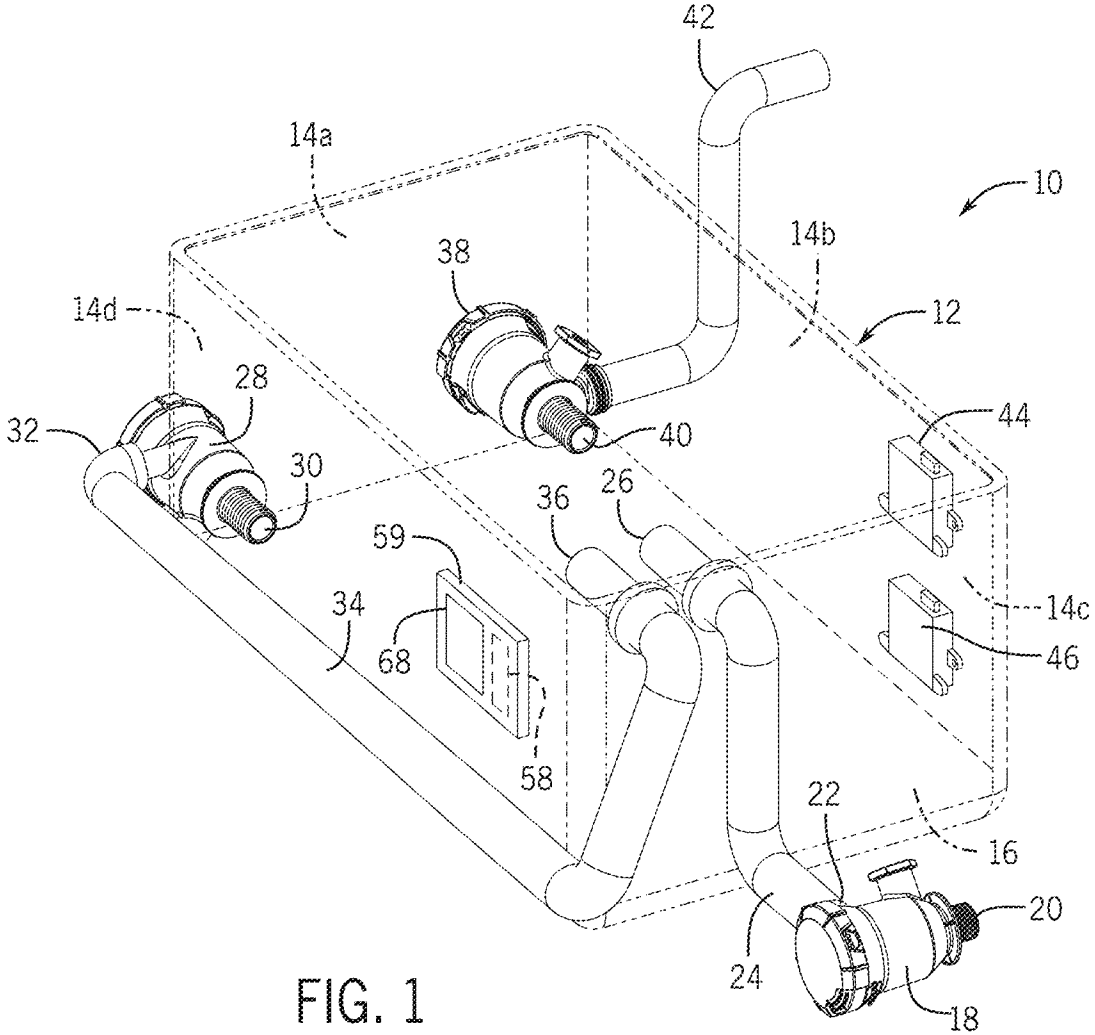
FIG. 1 (PRIOR ART)
FIG. 1 illustrates an example of a livewell system.

Before any embodiments of the invention are explained in detail, it is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Unless otherwise specified or limited, the phrases "at least one of A, B, and C," "one or more of A, B, and C," and the like, are meant to indicate A, or B, or C, or any combination of A, B, and/or C, including combinations with multiple instances of A, B, and/or C. Likewise, unless otherwise specified or limited, the terms "mounted," "connected," "linked," "supported," and "coupled" and variations thereof are used broadly and encompass both direct and indirect mountings, connections, supports, and couplings. Further, unless otherwise specified or limited, "connected" and "coupled" are not restricted to physical or mechanical connections or couplings.

As used herein, unless otherwise limited or defined, discussion of particular directions is provided by example only, with regard to particular embodiments or relevant illustrations. For example, discussion of "top," "bottom," "front," "back," "left," "right," "lateral" or "longitudinal" features is generally intended as a description only of the orientation of such features relative to a reference frame of a particular example or illustration. Correspondingly, for example, a "top" feature may sometimes be disposed below a "bottom" feature (and so on), in some arrangements or embodiments. Additionally, use of the words "first," "second", "third," etc. is not intended to connote priority or importance, but merely to distinguish one of several similar elements from another.

As used here, the term "livewell" is broader than its typical use, and encompasses any holding tanks, livewells, baitwells, or fish tanks, whether boat-mounted or not, configured to contain water for supporting aquatic life. For example, livewells are used to hold fish or other aquatic animals that are intended to be transferred back to the water from which they were caught or into another tank.

Referring to FIG. 1, a typical livewell system 10 includes a tank 12 configured to hold water. In one example, the livewell system 10 is configured to be installed on a marine vessel, although it could instead be installed on land or it could be portable. The tank 12 has four sidewalls 14*a-d* and a bottom wall 16. A lid 17 (FIG. 2) may be provided to cover the tank 12. The livewell system 10 also includes a fill pump 18 configured to pump water into the tank 12 from a body of water (e.g., a lake, river, etc.) external to the tank 12, such as water in which the marine vessel is operating. The fill pump 18 has a suction inlet 20, which may include a strainer net, or other type of mesh, through which water in the body of water is drawn into the fill pump 18. The fill pump 18 also has an outlet 22 through which water is pumped into the tank 12 via a conduit 24. The water may enter the tank 12 through a fill inlet 26. If the tank 12 is installed on land, no fill pump 18 may be required, and the conduit 24 can instead be connected to a plumbed source of water.

The livewell system 10 also includes a recirculation pump 28 configured to pump water out of the tank 12 and subsequently back into the tank 12 so as to oxygenate the water. The recirculation pump 28 has a suction inlet 30 configured to draw water into the recirculation pump 28 from the tank 12. The suction inlet 30 may also be provided with a strainer or the like to prevent fish or debris in the tank 12 from being sucked into the recirculation pump 28. The recirculation pump 28 also has an outlet 32, which connects back to the tank 12 via a conduit 34. The recirculated water may re-enter the tank 12 through a fill inlet 36, which may be equipped with an aerator spray head 29 (see FIGS. 3, 6).

The livewell system 10 also includes a drain pump 38 configured to pump water out of the tank 12 and into the body of water or into a bilge of the marine vessel, after which it may be pumped into the body of water by a bilge pump. The drain pump 38 has a suction inlet 40, which may be fitted with a strainer or the like for the same purposes noted hereinabove. The drain pump 38 also includes an outlet (not shown), which connects to a conduit 42 leading overboard or to the bilge.

By way of internal or external diverter valves, any two or all three of the pumps 18, 28, 38 could be used to perform more than one function. For example, a single pump could be used to pump fresh water into the tank 12 or to recirculate water out of and back into the tank 12. A single pump could be used to drain water out of the tank 12 or to recirculate water out of and back into the tank 12. A single pump could be used to pump fresh water in to the tank 12, recirculate water out of and back into the tank 12, or to drain the tank 12. The internal or external diverter valves would be controlled by a controller 58, discussed further herein below, to provide water from the desired source to the desired outlet.

The livewell system 10 also may include water-level sensors, such as upper water-level sensor 44 and lower water-level sensor 46. The water-level sensors 44, 46 may be used to control filling of the tank 12 with water. For example, when neither the upper water-level sensor 44 nor the lower water-level sensor 46 senses water, the fill pump 18 may be activated to fill the tank 12. The fill pump 18 may then be turned off when both the upper water-level sensor 44 and the lower water-level sensor 46 sense water, in order to avoid overfilling the tank 12. As is known, an overfill outlet (not shown) may also be provided in the tank 12 as a way to control any overflow that might occur due to overfilling the tank 12 with water and/or due to the addition of fish into the tank 12.

A controller 58 is provided in signal communication with the fill pump 18, the recirculation pump 28, the drain pump 38, the upper and lower water-level sensors 44, 46 and any diverter valves directing flow to or within the pumps 18, 28, 38. The controller 58 is located on or within a housing 59, for example, as a component on an integrated circuit within the housing 59. Although the controller housing 59 is shown as being provided on the wall 14*d* of the tank 12, the controller 58 could be provided elsewhere, such as for example as part of one or more of the pumps 18, 28, 38. In one example, the controller 58 is wired to the various components of the livewell system 10, such as by way of direct wiring or by way of a serial bus. In another example, the controller 58 may be remote from the tank 12 and is equipped with a wireless transceiver, and the various components with which the controller 58 communicates are each provided with wireless capabilities for communicating with the controller 58. Exemplary wireless protocols that could be used for this purpose include, but are not limited to, Bluetooth®, Bluetooth Low Energy (BLE), ANT, and ZigBee.

The controller 58 is configured to provide one-way or two-way communication between the controller 58 and one or more of the pumps 18, 28, 38. All pumps 18, 28, 38 are shown as being centrifugal pumps, but another type of pump could be used, such as a displacement pump. In other examples, the pumps 18, 28, 38 are different types than one another. For example, referring specifically to the fill pump 18, the pump includes the above-noted suction inlet 20. Water is drawn into the fill pump 18 via the suction inlet 20 by an impeller (not shown) which is powered by an electric motor (not shown). The impeller is configured such that water is pumped out under pressure via the outlet 22. The controller 58 is in signal and/or direct electrical communication with the electric motor that powers the impeller so as to turn the electric motor on or off and optionally so as to control the speed thereof.

Through research and development, the present inventors have discovered that the installation of multiple fill inlets 26, 36 results in an increased part count, as well as requires multiple holes to be drilled into the tank 12, resulting in increased labor time, increased costs, and an additional potential leak path. Additionally, in current systems there is no precise method for controlling the water level relative to the spray head 29, as the water-level sensors 44, 46 and the spray head are typically installed remote from one another. The spray head 29 aerates the water, increasing the dissolved oxygen content as the water droplets are projected onto the water surface from above and agitate the water surface, which is critical to fish survival. Some aerator spray heads include venturi holes 15 (FIG. 3) for introducing air into the water as it is sprayed, which further increases the oxygen level in the stream of water. In some cases, a tank 12 may be overfilled such that the gap between the water surface and the spray head 29 is so small that adequate aeration is not possible, or even to the point where the spray head 29 is fully submerged. For example, if the gap between the water surface and the outlet of the aerator spray head is too small, the surface of the water is not sufficiently agitated. If the aerator spray head is fully submerged, the surface of the water is also not sufficiently agitated and air is not able to enter the water stream via the venturi holes 15 in the spray head 29. The present inventors have therefore developed a livewell assembly 100 (FIGS. 2, 3) which is configured to provide water to the livewell tank 12 from the fill pump 18 and the recirculation pump 28 via a single common inlet. Further, the livewell assembly 100 includes a housing for a water level sensor such that the level of the water can be precisely and consistently controlled with respect to the spray head 29.

Figure 2:
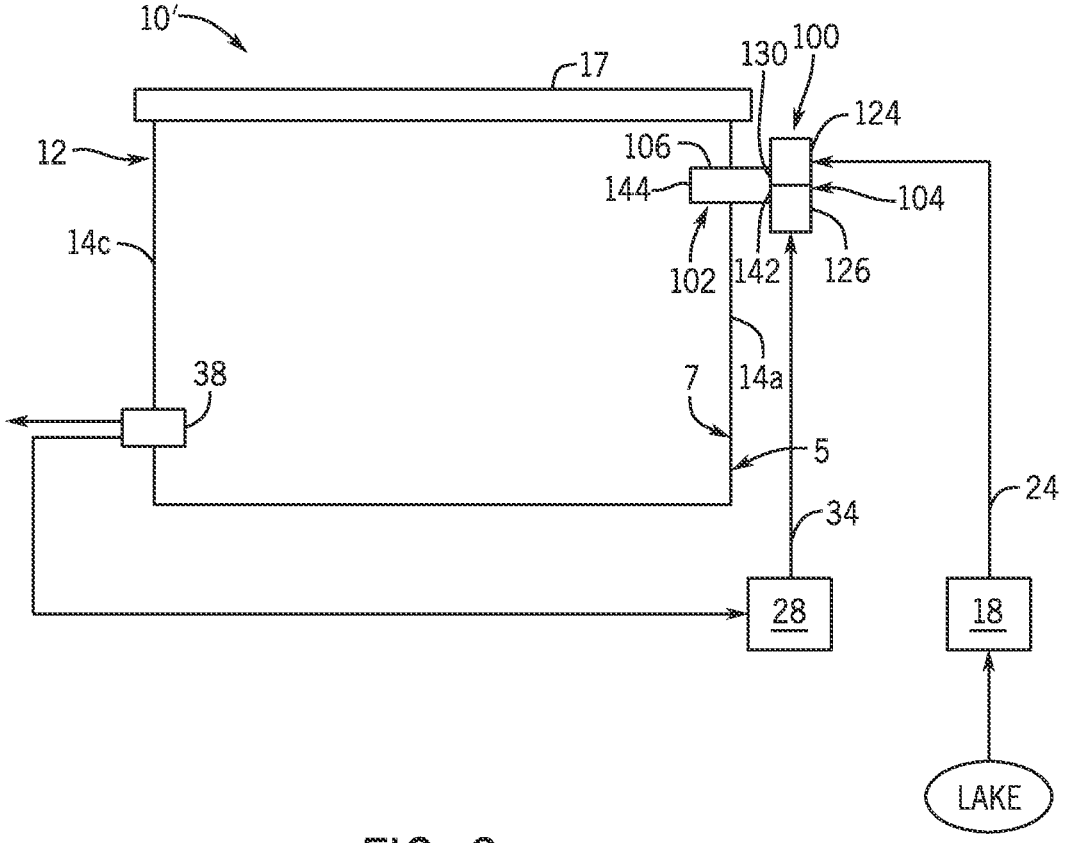
FIG. 2 is a schematic of a livewell system according to the present disclosure.

Referring to FIG. 2, the system 10' of the present disclosure includes the tank 12, the fill pump 18, the recirculation pump 28, and the drain pump 38, as described with respect to FIG. 1. The tank 12 further has an improved livewell assembly 100, which includes a first fitting 102 and a second fitting 104. The first fitting 102 is supported on the tank 12 and is configured to support and provide water to the spray head 29. The second fitting 104 is coupled to the first fitting 102 and fluidically couples the first fitting 102 and the spray head 29 to the fill pump 18 and the recirculation pump 28.

Referring to FIGS. 2-4 and 6, the first fitting 102 includes a cylindrical body 106 and a housing 108 depending downwardly from the cylindrical body 106. The cylindrical body 106 is configured to extend perpendicularly to and through a hole (not shown) in the side wall 14*a* of the tank 12. The cylindrical body 106 has an inlet 142 configured to be coupled to the second fitting 104, a threaded outer surface 107, and an outlet 144 configured to be coupled to the spray head 29. The cylindrical body 106 further includes a channel 109 recessed within the threaded outer surface 107 of the body 106, which channel 109 extends along the length of the cylindrical body 106 and is configured to house electrical components. A threaded slip nut 140 threadingly engages with the threaded outer surface 107 of the cylindrical body 106 and with a flanged end 146 of the spray head 29, such that the spray head 29 is coupled to the first fitting 102 adjacent the outlet 144 of the cylindrical body 106.

Figure 7:
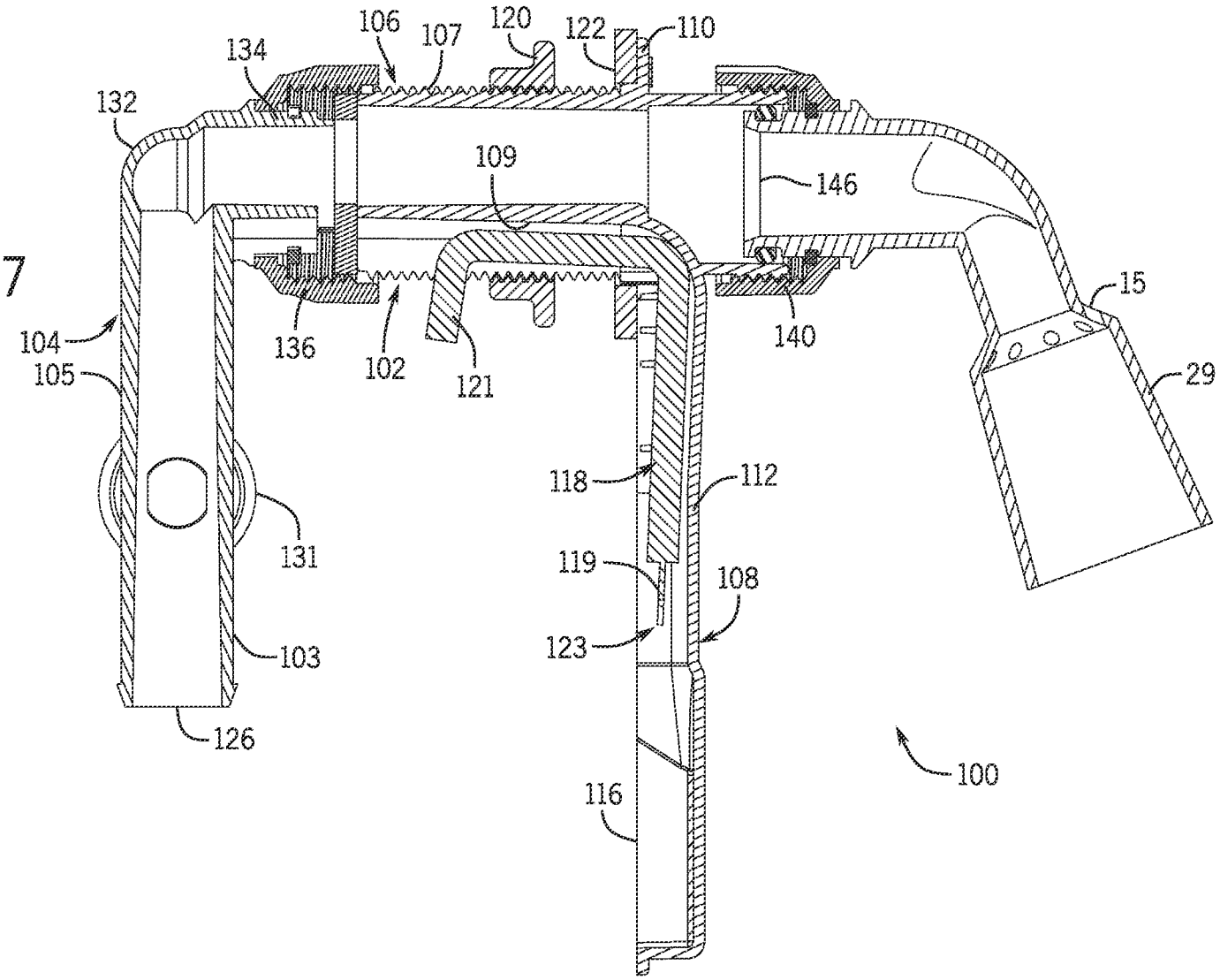
FIG. 7 illustrates a side sectional view of the livewell assembly.
Figure 10:
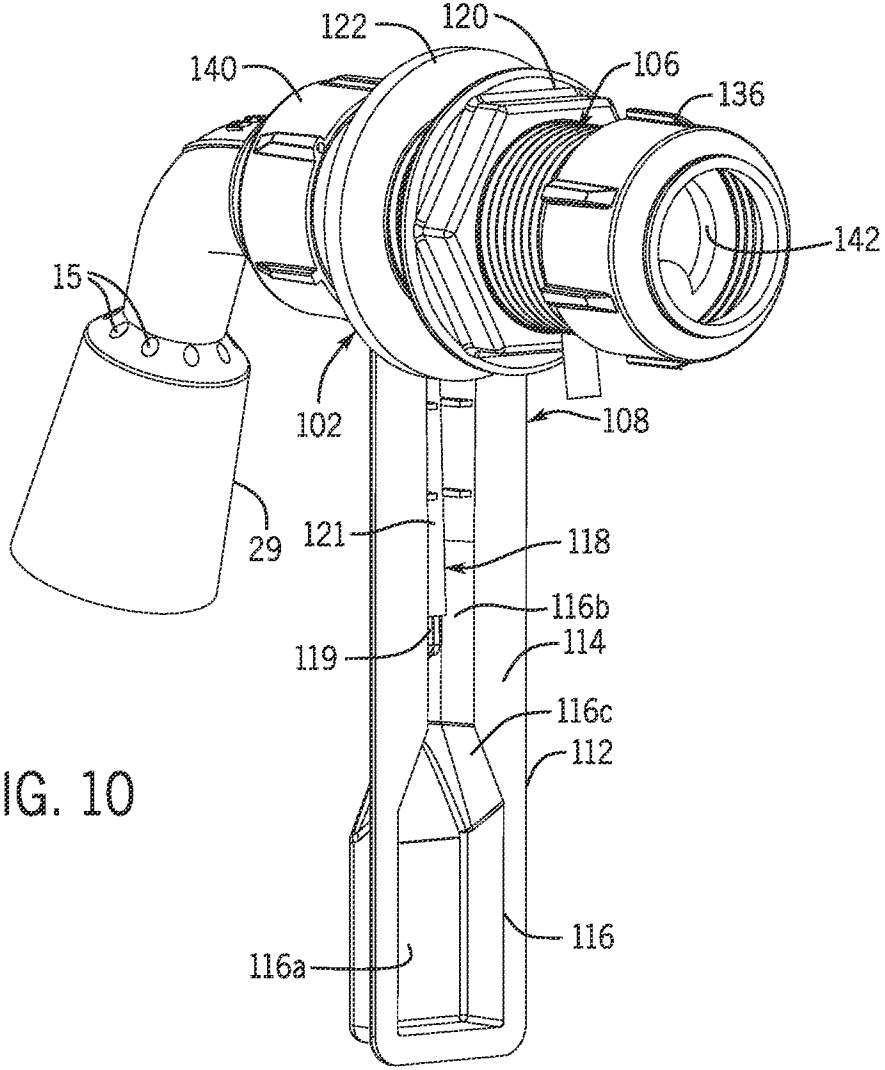
FIG. 10 illustrates a perspective view of the first fitting with a spray head attached thereto.
Figure 9:
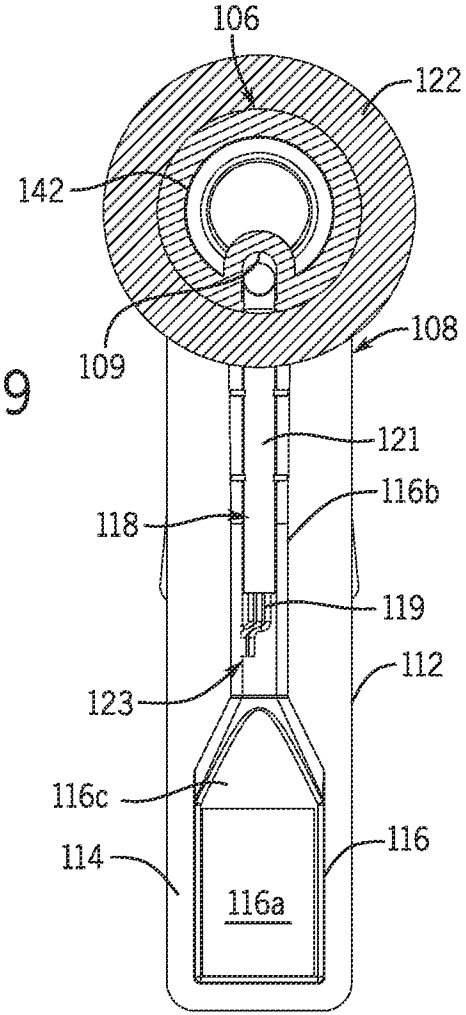
FIG. 9 illustrates a sectional view of the first fitting from an outlet toward an inlet thereof.

The housing 108 includes a collar 110 which extends around the cylindrical body 106 and couples the housing 108 to the cylindrical body 106. A body 112 of the housing 108 extends downward from the collar 110. The body 112 has an inner flat surface 114, which is configured to extend parallel to and, in the present example, flush with an inner surface 7 of the side wall 14*a* of the tank 12. The body 112 further includes a chimney feature 116, which is recessed from the inner flat surface 114 of the housing 108 and which projects into the tank 12. The chimney feature 116 is configured to hold a water-level sensor 118. Referring also to FIGS. 9 and 10, the chimney feature 116 has a rectangular portion 116*a* and an elongated neck 116*b* which extends upwardly therefrom until the neck 116*b* connects with the channel 109 of the cylindrical body 106 as shown in FIG. 7. The rectangular portion 116*a* and the neck 116*b* are connected by a trapezoidal portion 116*c*, which controls and directs water in the vicinity of the housing 108 up into the neck 116*b*, where the water-level sensor 118 is located, while preventing the water-level sensor 118 from being inadvertently triggered by splashing water.

Figure 6:
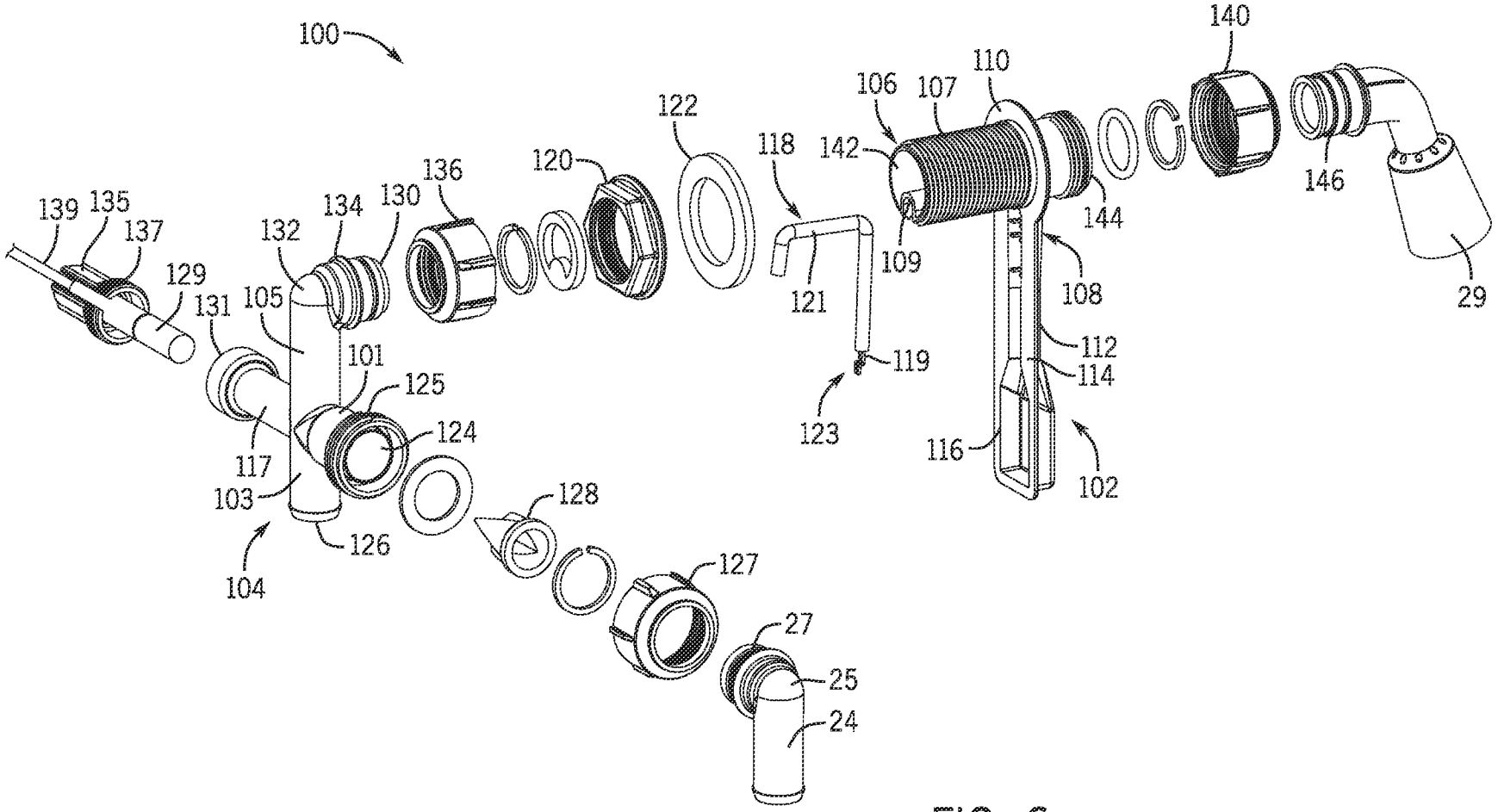
FIG. 6 illustrates an exploded view of the livewell assembly.

The water-level sensor 118, shown in FIG. 6, includes a pair or wires 119 which are substantially encased within a sheath 121. The sheath 121 and wires 119 extend through the channel 109 and are connected to the controller 58, although such connection is not shown here. The water-level sensor 118 in this is example is a capacitance sensor having wires 119 with exposed ends 123 (FIG. 9), which extend downwardly into the tank 12, such that when the water level rises up to the exposed ends 123, an electrical circuit is completed between the two wires 119 and the presence of water is indicated to the controller 58. Other types of water-level sensors such as optical sensors, ultrasonic sensors, or float sensors may instead be used. The housing 108 provides protection for the water-level sensor 118 from damage which may occur due to impact with fish, nets, and/or the like. Additionally, because the water-level sensor 118 is fixed within the housing 108 of the first fitting 102, which also supports the spray head 29, a known fixed distance is maintained between the spray head 29 and the water-level sensor 118. Thus, the level of the water can be consistently controlled with respect to the spray head 29. In one example, the outlet of the spray head 29 and the exposed probe ends 123 of the water-level sensor 118 are at a fixed vertical distance of 1.5 to 2 inches from one another. Having this distance be fixed as determined by the geometry of the first fitting 102 and the spray head 29 ensures there is a required minimum distance between the outlet of the spray head 29 and the surface of the water as required for optimal aeration, as opposed to a water-level sensor installed elsewhere on the tank 12, remote from the spray head 29. (See, for example, water-level sensors 44, 46 in FIG. 1.)

Returning to FIGS. 2 and 3, the cylindrical body 106 of the first fitting 102 extends through a hole in the side wall 14*a* of the tank 12, to which it is secured via a threaded nut 120 and a washer 122. During installation, the washer 122 is placed over the body 106 of the first fitting 102 and adjacent the collar 110 of the housing 108. The first fitting 102 is then placed adjacent the inner surface 7 of the side wall 14*a* of the tank 12 and the end of the body 106 having the inlet 142 is inserted through the hole in the side wall 14*a*. The body 106 is pushed through the hole until the washer 122 abuts the inner surface 7 of the side wall 14*a*. The threaded nut 120 is then placed over the end of the body 106 having the inlet 142, and the threaded nut 120 is rotated into engagement with the threaded outer surface 107 until the threaded nut 120 abuts an outer surface 5 of the side wall 14*a*. In this manner, the first fitting 102 is securely clamped to the side wall 14*a* of the tank 12 by way of the nut 120 on the outer surface 5 of the side wall 14*a* and the washer 122 and collar 110 on the inner surface 7 of the side wall 14*a*. The recessed channel 109 allows the threaded nut 120 and washer 122 to be threaded over the cylindrical body 106 without interfering with the wires 119 or sheath 121 of the water-level sensor 118, which are fully recessed within the channel 109.

Figure 3:
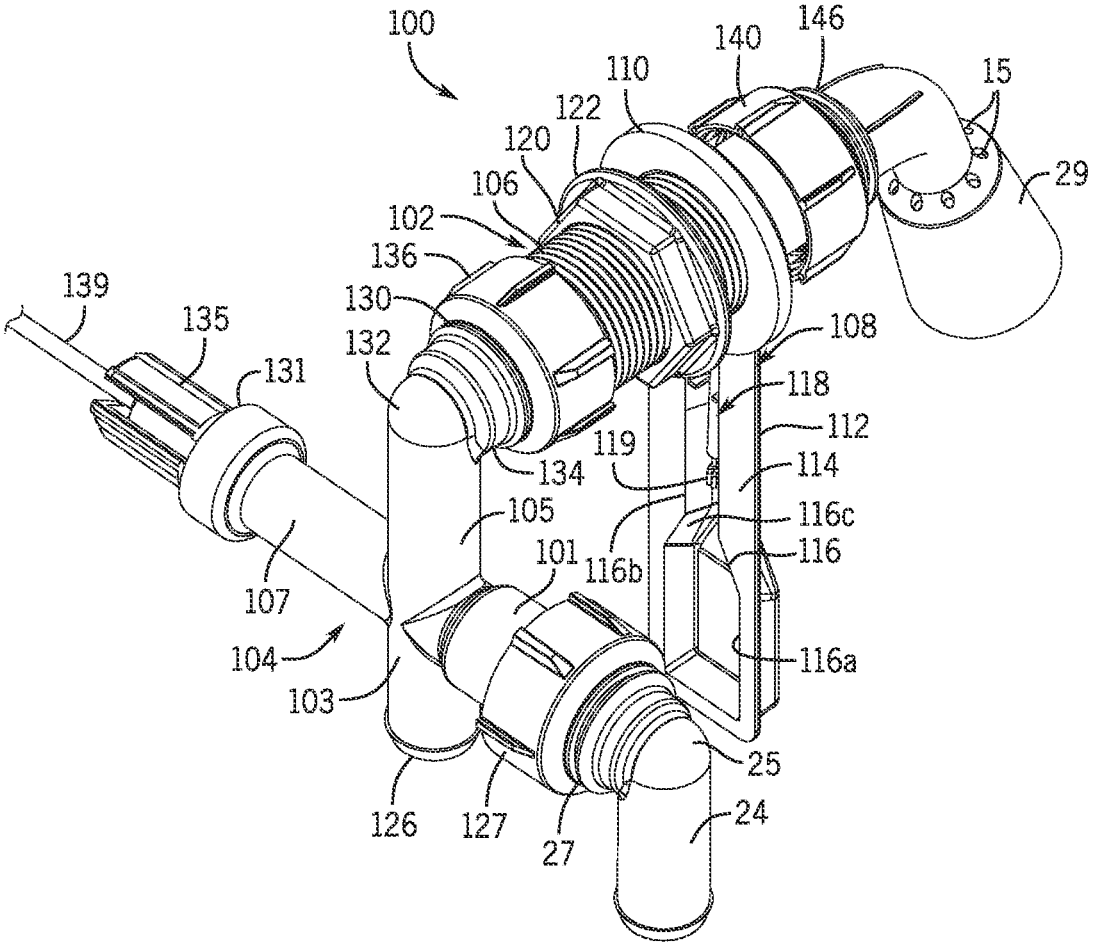
FIG. 3 illustrates a perspective view of an assembly for the livewell system.
Figure 4:
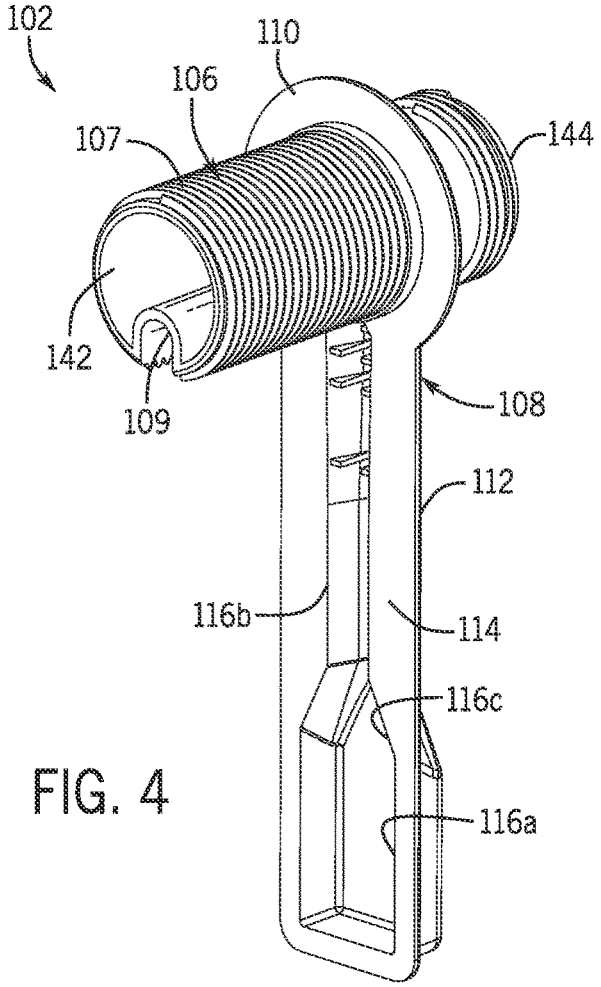
FIG. 4 illustrates a perspective view of a first fitting of the livewell assembly.
Figure 5:
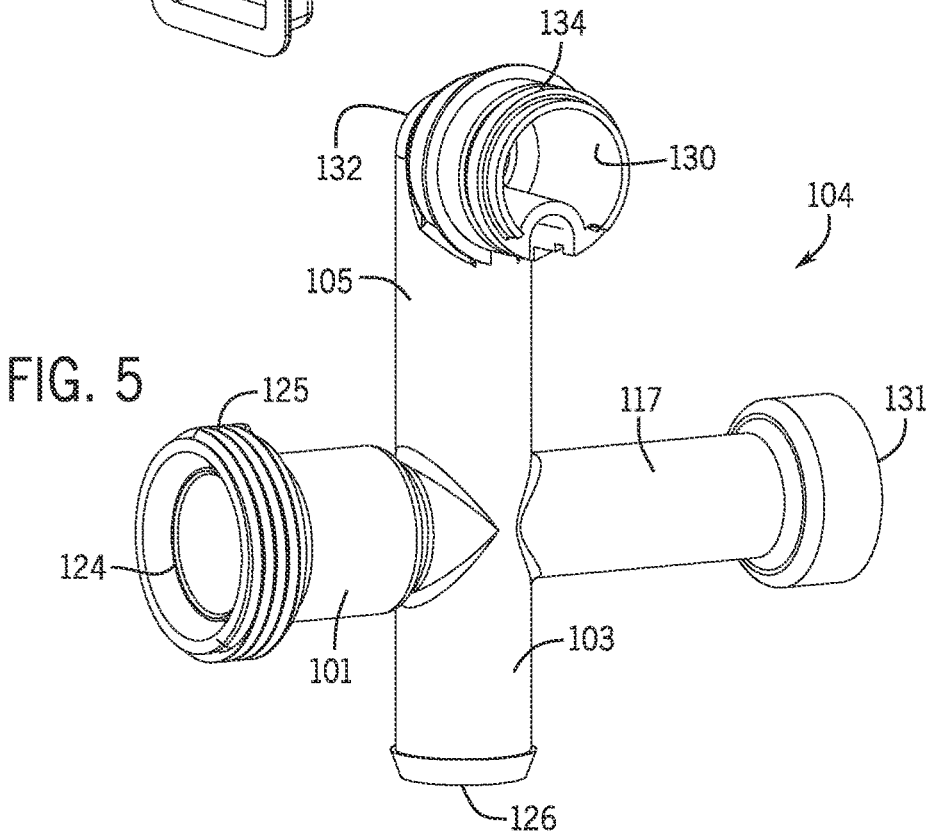
FIG. 5 illustrates a perspective view of a second fitting of the livewell assembly.

Referring now to FIGS. 2, 3, and 5, the second fitting 104 is a 4-way fitting having a first arm 101, a second arm 103, a third arm 105, and a fourth arm 117. The second fitting 104 includes a first inlet 124, a second inlet 126, and an outlet 130. The first inlet 124 is located on the first arm 101, which is configured to be in fluid communication with the fill pump 18, and thereby provides water from an external source of water to the spray head 29. The second inlet 126 is located on the second arm 103, which extends perpendicularly to the first arm 101 and is configured to be in fluid communication with the recirculation pump 28, and thereby provides water from the tank 12 to the spray head 29. The outlet 130 is located on the third arm 105, which extends perpendicularly to the first arm 101 and extends continuously from the second arm 103. The third arm 105 is fluidically coupled to the first arm 101, the second arm 103, and the first fitting 102 such that water from the first inlet 124 and the second inlet 126 can be dispensed into the tank 12 via the spray head 29.

Referring primarily to FIGS. 3 and 5, as noted, the first arm 101 is configured to be coupled to the conduit 24 of the fill pump 18. The first arm 101 includes a threaded end 125 at the first inlet 124. The conduit 24 includes an elbow 25 having a flanged end 27. (In other examples, the elbow 25 may be a separate component connected to the conduit 24.) A threaded slip nut 127 engaged with the flanged end 27 of the elbow 25 threadingly engages with the threaded end 125 of the first arm 101, thereby coupling the first inlet 124 to the fill pump 18. The first arm 101 houses a non-return valve 128, best shown in FIGS. 6 and 8, which is situated downstream of the first inlet 124 such that water can travel from the fill pump 18 toward the spray head 29, but any water being recirculated via the second arm 103 is restricted from passing through the first inlet 124 toward the fill pump 18.

The second arm 103 is configured to be coupled to the conduit 34 of the recirculation pump 28. Although not shown, the coupling between the second arm 103 and the conduit 34 can be threaded, clamped, and/or the like. For example, the coupling between the second arm 103 and the conduit 34 can be made via a slip nut like that provided for coupling the first arm 101 to the conduit 24.

The third arm 105 extends perpendicular to the first arm 101 and the fourth arm 117, such that it is continuous with the second arm 103. The third arm 105 includes an elbow 132, which leads into a flanged end 134 at the outlet 130 for coupling with the first fitting 102. The flanged end 134 holds a threaded slip nut 136, which threadingly engages with the threaded outer surface 107 of the cylindrical body 106 to couple the outlet 130 of the second fitting 104 to the inlet 142 of the first fitting 102.

Figure 8:
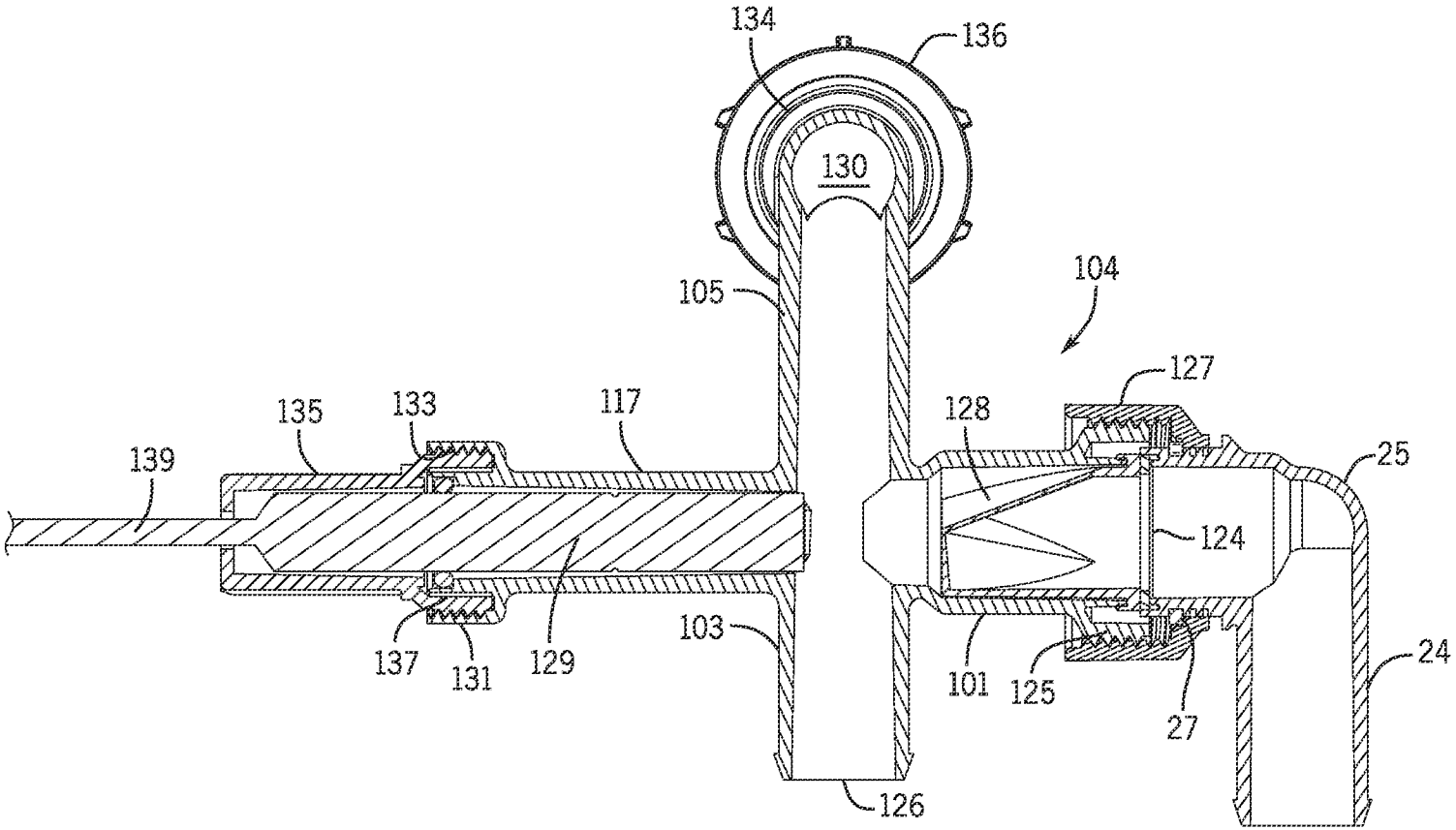
FIG. 8 illustrates a sectional view of the second fitting from a back end to a front end thereof.

The fourth arm 117 extends perpendicular to the second arm 103, such that it is continuous with the first arm 101, as shown in FIGS. 5 and 8. The fourth arm 117 is configured to house a dissolved oxygen (DO) sensor probe 129, such that the DO content of the water being dispensed into the tank 12 can be measured. The fourth arm 117 has a first end 131 which has internal threads 133 (FIG. 8) and is configured to receive the DO sensor probe 129. The DO sensor probe 129 includes an attachment housing 135. The attachment housing 135 is cylindrical, and includes an externally threaded end 137 for threadingly engaging with the internal threads 133 of the fourth arm 117. The DO sensor probe 129 extends within the attachment housing 135 and the fourth arm 117, and includes a wire 139 which extends outward from the attachment housing 135 for connection to the controller 58.

Throughout use of the livewell assembly 100, the fill pump 18 and the recirculation pump 28 may be alternately used for a variety of reasons such as to control temperature, DO content, ammonia content, etc. In the event that the fill pump 18 is indicated as the source for dispensing water into the tank 12, the fill pump 18 is configured to pump water to the spray head 29 in response to the water-level sensor 118 not sensing water, and is configured to stop pumping water to the spray head 29 in response to the water-level sensor 118 sensing water. In the event that the recirculation pump 28 is indicated as the source for dispensing water into the tank 12, the recirculation pump 28 is configured to pump water to the spray head 29 in response to the water-level sensor 118 not sensing water, and is configured to stop pumping water to the spray head 29 in response to the water-level sensor 118 sensing water.

For example, in use, the livewell assembly 100 is configured to dispense water into the tank 12 according to commands from the controller 58. When the water level is not high enough to reach the water-level sensor 118, the controller 58 causes water to be dispensed into the tank 12. Specifically, the controller 58 activates the fill pump 18, which pumps water through the first inlet 124 of the second fitting 104. Water then travels through the non-return valve 128 in the first arm 101, through the third arm 105, through the outlet 130 of the second fitting 104, and into the inlet 142 of the first fitting 102. Water then travels through the cylindrical body 106 before exiting the outlet 144 of the first fitting 102 and being dispensed via the spray head 29 into the tank 12. Once the water level reaches the exposed ends 123 of wires 119 and closes the circuit, the controller 58 stops the fill pump 18. An appropriate amount of hysteresis may be programmed into the controller 58 such that the fill pump 18 does not cycle between starting and stopping every time the water level changes slightly. Alternatively, a second low-level water sensor may be provided in the housing 108 or elsewhere on the tank 12 and in connection with the controller 58, which may be programmed not to turn on the fill pump 18 as long as the low-level water sensor senses water. In yet another example, the fill pump 18 is initially turned on by way of a user input to the controller 58 or directly to the fill pump 18 and is turned off by the controller 58 in response to the water-level sensor 118 sensing water.

The livewell assembly 100 is also configured to dispense water into the tank 12 by way of the recirculation pump 28, which may also be controlled by the controller 58 in response to the water-level sensor 118 sensing or not sensing water. For instance, if a significant number of fish are added to the tank 12 and the water level rises enough to reach the exposed probe ends 123 of the water-level sensor 118, the controller 58 will turn off the recirculation pump 28. Programming the controller 58 to turn off the recirculation pump 28 or prevent the recirculation pump 28 from turning on to recirculate water when the water level is too high saves energy, as the spray head 29 in such instances is too close to the water surface to be effective at increasing dissolved oxygen content. In alternative examples, the controller 58 may alert a user that the water level is too high for recirculation to be effective at increasing DO content and will ask the user if they want to pump water out using the drain pump 38, stop recirculating using the recirculation pump 28, or leave the water level high.

While water is being circulated through the second fitting 104 via the recirculation pump 28, the DO sensor probe 129, which is in fluid communication with the second arm 103, is configured to output DO content readings to the controller 58. In some instances, both the fill pump 18 and the recirculation pump 28 may be operated at the same time in response to the water-level sensor 118 not sensing water, such as if the DO sensor probe 129 senses that the DO content is too low. The controller 58 may thus control the recirculation pump 28 based not only on the level of water in the tank 12 as determined by the water-level sensor 118, but also based on the DO content as determined by the DO sensor probe 129. In some instances, if the controller 58 determines that the water level has been too high for more than a threshold time period, and optionally if the DO content of the water is at the same time too low, the controller 58 may be configured to pump water out of the tank 12 by way of the drain pump 38. Once the water level is low enough that the water-level sensor 118 no longer senses water, the controller 58 will re-start the recirculation pump 38 so as to aerate the water until the DO sensor probe 129 indicates the DO content is back within a predetermined range.

Although the present description has discussed the external source of water as being connected to the first inlet 124, the first inlet 124 could instead be provided with water from the tank 12 by way of the recirculation pump 28, while the second inlet 126 is provided with water from the external source via the fill pump 18. Further, the non-return valve 128 could be provided in the second arm 103 to prevent backflow from the first inlet 124 into the second inlet 126. In further aspects, non-return valves could be provided in both the first arm 101 and the second arm 103. The non-return valve could be a nozzle-type check valve as shown here, or in other examples could be a ball check valve, a disc check valve, or other known mechanical one-way valve. In still other examples, the non-return valve could be electromechanical, such that the controller 58 closes the valve when the recirculation pump 28 is running and the fill pump 18 is not running (or vice versa, depending on the location of the valve).

Therefore, according to one example of the present disclosure, an assembly 100 for a livewell comprises a first fitting 102 and a second fitting 104. The first fitting 102 is configured to support and provide water to a spray head 29 configured to spray water into a livewell to which the assembly 100 is coupled. The second fitting 104 is coupled to the first fitting 102 and comprises at least two inlets 124, 126 and at least one outlet 130, the at least one outlet 130 being in fluid communication with the first fitting 102. A first inlet 124 of the at least two inlets is in fluid communication with a first source of water (e.g., a body of water in which a marine vessel is operating) to provide water from the first source to the spray head 29, and a second inlet 126 of the at least two inlets is in fluid communication with a different second source of water (e.g., the livewell tank 12) to provide water from the second source to the spray head 29.

In non-limiting examples disclosed herein, the assembly 100 further comprises a water-level sensor 118 supported by the first fitting 102.

In non-limiting examples disclosed herein, the first fitting comprises a housing 108 for holding the water-level sensor 118.

In non-limiting examples disclosed herein, the housing 108 comprises a chimney feature 116 which is configured to hold exposed probe ends 123 of the water-level sensor 118.

In non-limiting examples disclosed herein, the first fitting 102 comprises a threaded outer surface 107 for receiving a threaded nut 120 configured to clamp the first fitting 102 to a wall **14*a* of the livewell. The first fitting 102 further comprises a channel 109 recessed within the threaded outer surface 107 and configured to hold wires 119 of the water-level sensor 118**.

In non-limiting examples disclosed herein, the assembly 100 further comprises a pump 18 configured to pump water from the first source to the spray head 29, wherein the pump 18 is configured to pump water to the spray head 29 in response to the water-level sensor 118 not sensing water. The pump 18 is further configured to stop pumping water to the spray head 29 in response to the water-level sensor 118 sensing water.

In non-limiting examples disclosed herein, the assembly 100 further comprises a first pump 18 and a second pump 28. The first pump 18 is configured to pump water from the first source to the spray head 29. In some aspects, the first pump 18 is configured to pump water to the spray head 29 in response to the water-level sensor 118 not sensing water and the first pump 18 is further configured to stop pumping water to the spray head 29 in response to the water-level sensor 118 sensing water. The second pump 28 is configured to pump water from the second source to the spray head 29. In some aspects, the second pump 28 is configured to pump water to the spray head 29 in response to the water-level sensor 118 not sensing water and the second pump 28 is further configured to stop pumping water to the spray head 29 in response to the water-level sensor 118 sensing water.

In non-limiting examples disclosed herein, the second fitting 104 is a 4-way fitting, the first inlet 124 is located on a first arm 101 of the second fitting 104, the second inlet 126 is located on a second arm 103 of the second fitting 104, the at least one outlet 130 is located on a third arm 105 of the second fitting 104, and a sensor probe 129 is installed in a fourth arm 117 of the second fitting 104.

In non-limiting examples disclosed herein, the sensor probe 129 is a dissolved oxygen probe.

In non-limiting examples disclosed herein, the assembly 100 further comprises a non-return valve 128 situated downstream of the first inlet 124, wherein the non-return valve 128 is configured to prevent water that enters the second fitting 104 by way of the second inlet 126 from backflowing through the first inlet 124.

In non-limiting examples disclosed herein, the at least one outlet 130 is a single outlet and the first fitting 102 is a single fitting comprising a body 106 configured to extend through a hole in a wall 14*a* of the livewell.

According to another example of the present disclosure, an assembly 100 for a livewell comprises a first fitting 102, a water-level sensor 118 supported by the first fitting 102, and a second fitting 104. The first fitting 102 has an outlet 144 configured to provide water into a livewell to which the assembly 100 is coupled. The second fitting 104 has at least two inlets 124, 126 and at least one outlet 130, the at least one outlet 130 of the second fitting 104 being in fluid communication with an inlet 142 of the first fitting 102.

In non-limiting examples disclosed herein, the first fitting 102 comprises a housing 108 for holding the water-level sensor 118.

In non-limiting examples disclosed herein, the housing 108 comprises a chimney feature 116 configured to hold exposed probe ends 123 of the water-level sensor 118.

In non-limiting examples disclosed herein, the first fitting 102 comprises a threaded outer surface 107 for receiving a threaded nut 120 configured to clamp the first fitting 102 to a wall 14*a* of the livewell and a channel 109 recessed within the threaded outer surface 107 and configured to hold wires 119 of the water-level sensor 118.

In non-limiting examples disclosed herein, the assembly 100 further comprises a non-return valve 128 situated downstream of a first inlet 124 of the at least two inlets of the second fitting 104, wherein the non-return valve 128 is configured to prevent water that enters the second fitting 104 by way of a second inlet 126 of the at least two inlets from backflowing through the first inlet 124.

In non-limiting examples disclosed herein, the second fitting 104 is a 4-way fitting, wherein the at least two inlets comprise a first inlet 124 located on a first arm 101 of the second fitting 104 and a second inlet 126 located on a second arm 103 of the second fitting 104. The at least one outlet 130 is located on a third arm 105 of the second fitting 104 and a sensor probe 129 is installed in a fourth arm 117 of the second fitting 104.

In non-limiting examples disclosed herein, a first inlet 124 of the at least two inlets of the second fitting 104 is in fluid communication with a first source of water (e.g., a body of water in which a marine vessel is operating) to provide water from the first source to the livewell, and a second inlet 126 of the at least two inlets of the second fitting is in fluid communication with a different second source of water (e.g., the livewell tank 12) to provide water from the second source to the livewell.

In non-limiting examples disclosed herein, the at least one outlet 130 of the second fitting 104 is a single outlet and the first fitting 102 is a single fitting comprising a body 106 configured to extend through a hole in a wall 14*a* of the livewell.

In non-limiting examples disclosed herein, the first fitting 102 is configured to support a spray head 29 adjacent the outlet 144 of the first fitting 102.

In the present description, certain terms have been used for brevity, clarity, and understanding. No unnecessary limitations are to be implied therefrom beyond the requirement of the prior art because such terms are used for descriptive purposes only and are intended to be broadly construed. The different components and assemblies described herein may be used or sold separately or in combination with other components and assemblies. Various equivalents, alternatives, and modifications are possible within the scope of the appended claims.

What is claimed is:

1. An assembly for a livewell, the assembly comprising:

a first fitting configured to support and provide water to a spray head configured to spray water into a livewell to which the assembly is coupled;

a second fitting coupled to the first fitting, the second fitting comprising at least two inlets and at least one outlet, the at least one outlet being in fluid communication with the first fitting; and a water-level sensor supported by the first fitting, wherein the first fitting comprises a housing for holding the water-level sensor;

wherein a first inlet of the at least two inlets is in fluid communication with a first source of water to provide water from the first source to the spray head; and wherein a second inlet of the at least two inlets is in fluid communication with a different second source of water to provide water from the second source to the spray head.

2. The assembly of claim 1, wherein the housing comprises a chimney feature configured to hold exposed probe ends of the water-level sensor.

3. The assembly of claim 1, further comprising a pump configured to pump water from the first source to the spray head;

wherein the pump is configured to pump water to the spray head in response to the water-level sensor not sensing water; and wherein the pump is configured to stop pumping water to the spray head in response to the water-level sensor sensing water.

4. The assembly of claim 1, further comprising:

a first pump configured to pump water from the first source to the spray head;

wherein the first pump is configured to pump water to the spray head in response to the water-level sensor not sensing water; and wherein the first pump is configured to stop pumping water to the spray head in response to the water-level sensor sensing water; and a second pump configured to pump water from the second source to the spray head;

wherein the second pump is configured to pump water to the spray head in response to the water-level sensor not sensing water; and wherein the second pump is configured to stop pumping water to the spray head in response to the water-level sensor sensing water.

5. The assembly of claim 1, further comprising a non-return valve situated downstream of the first inlet, wherein the non-return valve is configured to prevent water that enters the second fitting by way of the second inlet from backflowing through the first inlet.

6. The assembly of claim 1, wherein the at least one outlet is a single outlet; and wherein the first fitting is a single fitting comprising a body configured to extend through a hole in a wall of the livewell.

7. The assembly of claim 1, wherein the housing of the first fitting comprises a collar and a body, wherein the collar couples the body to the first fitting.

8. The assembly of claim 1, wherein the housing extends downwardly from the first fitting into the livewell to which the assembly is coupled.

9. An assembly for a livewell, the assembly comprising:

a first fitting configured to support and provide water to a spray head configured to spray water into a livewell to which the assembly is coupled;

a second fitting coupled to the first fitting, the second fitting comprising at least two inlets and at least one outlet, the at least one outlet being in fluid communication with the first fitting; and a water-level sensor supported by the first fitting;

wherein a first inlet of the at least two inlets is in fluid communication with a first source of water to provide water from the first source to the spray head;

wherein a second inlet of the at least two inlets is in fluid communication with a different second source of water to provide water from the second source to the spray head; and wherein the first fitting comprises:

a threaded outer surface for receiving a threaded nut configured to clamp the first fitting to a wall of the livewell; and a channel recessed within the threaded outer surface and configured to hold wires of the water-level sensor.

10. An assembly for a livewell, the assembly comprising:

a first fitting configured to support and provide water to a spray head configured to spray water into a livewell to which the assembly is coupled; and a second fitting coupled to the first fitting, the second fitting comprising at least two inlets and at least one outlet, the at least one outlet being in fluid communication with the first fitting;

wherein a first inlet of the at least two inlets is in fluid communication with a first source of water to provide water from the first source to the spray head;

wherein a second inlet of the at least two inlets is in fluid communication with a different second source of water to provide water from the second source to the spray head; and wherein the second fitting is a 4-way fitting, the first inlet is located on a first arm of the second fitting, the second inlet is located on a second arm of the second fitting, the at least one outlet is located on a third arm of the second fitting, and a sensor probe is installed in a fourth arm of the second fitting.

11. The assembly of claim 10, wherein the sensor probe is a dissolved oxygen probe.

12. An assembly for a livewell, the assembly comprising:

a first fitting having an outlet configured to provide water into a livewell to which the assembly is coupled;

a water-level sensor supported by the first fitting; and a second fitting having at least two inlets and at least one outlet, the at least one outlet of the second fitting being in fluid communication with an inlet of the first fitting;

wherein the first fitting comprises a housing for holding the water-level sensor.

13. The assembly of claim 12, wherein the housing comprises a chimney feature configured to hold exposed probe ends of the water-level sensor.

14. The assembly of claim 12, further comprising a non-return valve situated downstream of a first inlet of the at least two inlets of the second fitting;

wherein the non-return valve is configured to prevent water that enters the second fitting by way of a second inlet of the at least two inlets from backflowing through the first inlet.

15. The assembly of claim 12, wherein a first inlet of the at least two inlets of the second fitting is in fluid communication with a first source of water to provide water from the first source to the livewell; and wherein a second inlet of the at least two inlets of the second fitting is in fluid communication with a different second source of water to provide water from the second source to the livewell.

16. The assembly of claim 12, wherein the at least one outlet of the second fitting is a single outlet; and wherein the first fitting is a single fitting comprising a body configured to extend through a hole in a wall of the livewell.

17. The assembly of claim 12, wherein the first fitting is configured to support a spray head adjacent the outlet of the first fitting.

18. An assembly for a livewell, the assembly comprising:

a first fitting having an outlet configured to provide water into a livewell to which the assembly is coupled;

a water-level sensor supported by the first fitting; and a second fitting having at least two inlets and at least one outlet, the at least one outlet of the second fitting being in fluid communication with an inlet of the first fitting;

wherein the first fitting comprises:

a threaded outer surface for receiving a threaded nut configured to clamp the first fitting to a wall of the livewell; and a channel recessed within the threaded outer surface and configured to hold wires of the water-level sensor.

19. An assembly for a livewell, the assembly comprising:

a first fitting having an outlet configured to provide water into a livewell to which the assembly is coupled;

a water-level sensor supported by the first fitting; and a second fitting having at least two inlets and at least one outlet, the at least one outlet of the second fitting being in fluid communication with an inlet of the first fitting, wherein the second fitting is a 4-way fitting;

wherein the at least two inlets comprise a first inlet located on a first arm of the second fitting and a second inlet located on a second arm of the second fitting;

wherein the at least one outlet is located on a third arm of the second fitting; and wherein a sensor probe is installed in a fourth arm of the second fitting.

* * * * *